US012698949B2

(12) United States Patent
Gasser et al.

(10) Patent No.: US 12,698,949 B2
(45) Date of Patent: Aug. 4, 2026

(54) PERSONALIZED COMBAT SIMULATION EQUIPMENT

(71) Applicant: THALES SIMULATION & TRAINING AG, Bern (CH)

(72) Inventors: Rolf Gasser, Baltschieder (CH); Siani Tomer, Köniz (CH); Jonas Heil, Olten (CH)

(73) Assignee: THALES SIMULATION & TRAINING AG (CH)

( * ) Notice: Subject to any disclaimer, the term of this patent is extended or adjusted under 35 U.S.C. 154(b) by 0 days.

(21) Appl. No.: 18/579,164

(22) PCT Filed: Jul. 16, 2021

(86) PCT No.: PCT/EP2021/070037

§ 371 (c)(1),
(2) Date: Jan. 12, 2024

(87) PCT Pub. No.: WO2023/284986

PCT Pub. Date: Jan. 19, 2023

(65) Prior Publication Data

US 2024/0353201 A1 Oct. 24, 2024

(51) Int. Cl.

| | |
|---|---|
| ***F41J 5/02*** | (2006.01) |
| ***F41G 3/26*** | (2006.01) |
| ***F41J 5/14*** | (2006.01) |

(52) U.S. Cl.

CPC ..... *F41G 3/2605* (2013.01); *F41J 5/02* (2013.01); *F41J 5/14* (2013.01)

(58) Field of Classification Search

CPC ..... F41J 5/02; F41J 5/14

See application file for complete search history.

(56) References Cited

U.S. PATENT DOCUMENTS

| | | | |
|---|---|---|---|
| 8,770,976 | B2 | 7/2014 | Moser |
| 10,030,931 | B1 | 7/2018 | Black et al. |
| 10,527,390 | B1 | 1/2020 | Carter |
| 10,712,116 | B1 | 7/2020 | Baxter et al. |
| 2012/0088209 | A1 | 4/2012 | Poole et al. |
| 2020/0074696 | A1 | 3/2020 | Lyren |
| 2021/0148675 | A1 | 5/2021 | Stanley |

FOREIGN PATENT DOCUMENTS

| | | | |
|---|---|---|---|
| CN | 107180215 | B | 1/2020 |
| KR | 102005504 | B1 | 10/2019 |
| WO | WO 2014091324 | A1 | 6/2014 |
| WO | WO 2018089041 | A1 | 5/2018 |
| WO | WO2021048307 | A1 | 3/2021 |

OTHER PUBLICATIONS

International Search Report mailed May 19, 2022 in corresponding PCT International Application No. PCT/EP2021/070037.

*Primary Examiner* — Kesha Frisby

(74) *Attorney, Agent, or Firm* — OSTROLENK FABER LLP

(57) ABSTRACT

A personalized combat simulation equipment (6, 9) for use in combat training and simulation is attached to a weapon (10). By means of sensors (1, 2, 3, 5, 55), it detects the use of the weapon and is able to determine the position and the performance in use. Evaluation is performed by an evaluation unit (6), preferably an artificial intelligence unit. Its preferred use is in a training environment, where at least one of sensors watching the behaviour of participants and surveying objects are not present.

19 Claims, 2 Drawing Sheets

PERSONALIZED COMBAT SIMULATION EQUIPMENT

The present invention relates to a personalized combat simulation equipment according to the preamble of claim 1. Furthermore, it relates to a use of the personalized combat simulation equipment and a combat simulation method using the personalized combat simulation equipment.

State of the art in live simulation is that weapon effects are simulated using laser or radio signals. The effect of the ammunition is transmitted to a target equipped with laser detectors by means of a coded laser signal or radio telegrams. The resulting simulated effect of the weapon is decoded at the target, evaluated, and registered and/or transmitted to a higher-level control center via a radio network. In addition, each exercise participant must be located in the open terrain as well as inside buildings using additional infrastructure so that the respective positions of the targets and their condition are monitored and recorded at the control center. Thus, the use of weapons, their time of impact on the targets and the position of all participants are recorded at the control center.

However, this state of the art in live simulation still maintains disadvantages compared to real missions. The high level of infrastructure required to perform live simulations means that realistic training is only possible in a fixed instrumented environment on the one hand, and only with prior complex and mobile instrumentation on the other hand. This increases the costs for such exercises and the training sessions require correspondingly long preparation times. A lot of important information are not collected and evaluated with the current state of live simulation. E.g. the handling of weapons is not evaluated, only the effect on the targets.

Especially in the area of training of special forces, police and military, it is today only possible to a limited extent to conduct such exercises in a real environment (department stores, airplanes, public buildings) because its prior instrumentation would be too costly.

Therefore, an object of the present invention is a weapon simulating device which imposes fewer demands regarding the training environment.

Such a device is defined in claim 1. The further claims define preferred embodiments.

Another, preferred aim of the invention is, on the one hand, to expand the training with weapon systems by means of the use of artificial intelligence and additional sensor technology with further collected information and, on the other hand, to reduce the expenditure on instrumentation of weapons, of participants and of infrastructure as far as possible. Training in the use of weapon systems is to be simplified as far as possible. This should make it possible to increase the efficiency of the exercises. In addition, the quality of the evaluations with regard to the behaviour of the training participants should be improved.

The advantage of the invention is that by using it, on the one hand, exercises are very quickly and efficiently carried out in previously unknown terrain or buildings with a minimum of preparation time. On the other hand, the invention allows a much higher degree of additional evaluation of the correct behaviour of the exercise participants to increase the quality of the trainings. It is possible to record wrong behaviour at the wrong time. The goal is to optimally prepare the participants for their real mission and to optimize their behaviour during the real mission, which ultimately leads to their increased safety and success.

The invention will be further explained by way of preferred exemplary embodiment with reference to the Figures.

DEFINITIONS OF TERMS

Figure 1:
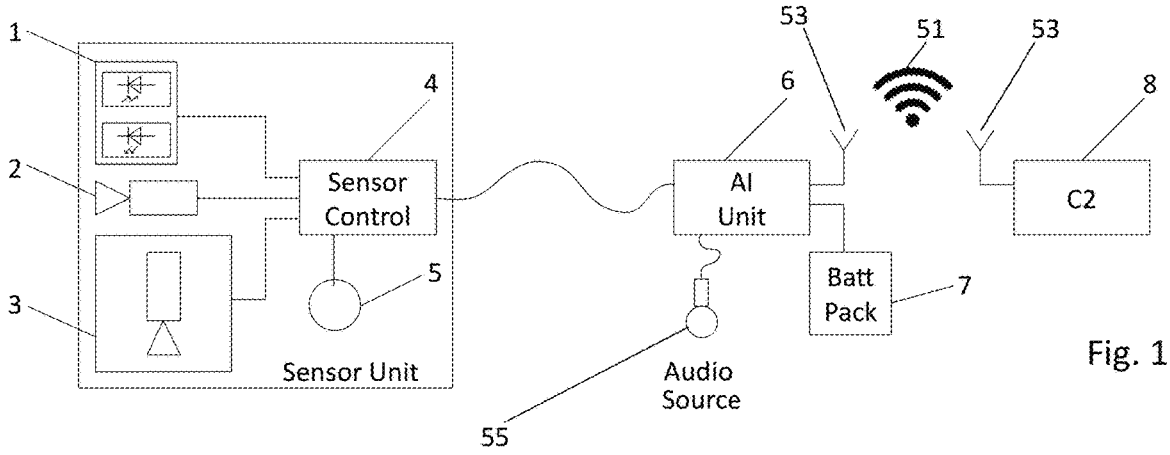
FIG. 1 shows the basic structure of the invention.

Artificial intelligence (AI) is a broader term existing since the mid-1950s in computer sciences. Nevertheless, even today no unique and clear definition of the term exists among scholars in the field, but rather a broader understanding of a task that a machine aims to perform that is to mimic human behaviour. Scholars in the field of computational sciences face the same problem regarding the task to find one unique and clear definition of further developments in the field. In the mid-1980s the term machine learning came up from the definition issues of AI to help describe how a task is performed by the computer. Nevertheless, still an abundance of definitions exists about the term machine learning. Although more progress is made in the field of computational sciences, as for example the development of deep learning from the field of machine learning that, broadly described, uses neural network structures to solve complex problems, in this patent the term artificial intelligence (AI) is used to describe highly complex algorithms in the field of machine learning and deep learning.

A Deep Neural Network is a neural work with at least one, generally more layers of nodes between the input and the output layer of nodes.

Human Recognition and Pose Recognition defines the problem of localization of human joints (key points as elbows, wrists, etc.) in images or videos. It also defines the search for specific human poses in space of all articulated poses. There exist different approaches to 2D and 3D Human Pose Estimation. The main component of human pose estimation builds the modelling of the human body. The three most used types of body models are: skeleton-based model, contour-based and volume-based model. With the help of Deep Neural Networks, such models could be recognized and tracked in real time. Within this invention no specific method is mentioned because most of them could be applied for this application. The only big differences between different Human Pose Estimation methods are the accuracy of recognition and the performance in such frameworks. To reach a higher accuracy of the human body recognition such a Deep Neural Network can be deeper trained with additional training data of available recorded poses. Training data may be images (e.g. still images taken by a camera) of a person in different poses with and without weapon and each time a thread label assigned which indicates the thread level. The images may also be simplified. The same is done for distinguishing if objects are dangerous: Images of objects to which thread levels are assigned are shown to the KI. Generally, the training is performed in a separate process ahead of the actual simulation, and during simulation, no further training of the KI occurs.

The Hit zone recognition allows detecting the exact hit zone on the human body during the simulated shot firing. It is based on the Human Body and Pose Recognition and captures during the shot triggering the aimed zone. This captured zone will be treated and recorded afterwards.

The Threat Recognition is also based on the Human Body and Pose Recognition methods. Specific dangerous appearing poses could be trained with the help of a Deep Neural Network. Such dangerous poses are then recognized in a real time video stream. This is combined with an object detection also based on Deep Neural Networks to detect dangerous objects carried by such a recognized human body.

According to one aspect, the Identification is based on Face Detection and Recognition with the help of Deep Learning, i.e. an AI technique. Also Face recognition is based on different existing methods. Most of the methods have in common that first a face must be recognized in a real time video or in a picture. It is often done by a method invented in 2005 called Histogram of Oriented Gradients (HOG, cf. U.S. Pat. No. 4,567,610, herein incorporated by reference). Then, the face is often identified with a method called face landmark estimation. The faces to be identified must be provided in a training set and trained with such a facial recognition Deep Neural Network.

The Georeferencing is based on the detection of beacons or markers called April Tags or Fiducial markers. April tags have been developed in the APRIL Robotics Laboratory at the University of Michigan led by Edwin Olson, cf. https://april.eecs.umich.edu/software/apriltag. An April tag resembles a QR code, yet with a far simpler structure and using bigger blocks. Its data payload is lower, e.g. 4 to 12 bits, and it is designed that the 3D position in relation to a sensor or a camera can be precisely determined. These tags or markers will be mounted on georeferenced points in the simulated area. The markers could be detected based on image treatment and decoded to read out the marked position.

Object Detection/Object Recognition describes a collection of related computer vision tasks that involve object identification in images or real time video streams. Object recognition allows identifying the location of one or more objects in an image or video stream. The objects are recognized and localized. This is performed with the help of AI, in particular Deep Learning algorithms used in many other applications. There exist a lot of pretrained Object Detection networks which could be applied in this invention. Additional objects which are not known in those pretrained networks could be trained additionally with additional prepared trainings sets.

Simultaneous Localization and Mapping (SLAM) allows the tracking and mapping within an unknown environment. Multiple SLAM algorithms exist and can be applied to such an application. Those systems are often based on the use of a camera and they allow to create a map in real time as well as to recognize the position based on the treatment of the video stream. The map is created online and georeferencing to a real map is possible at any time.

Speech Recognition/Speech to Text algorithms enable the recognition and translation of spoken language into text with the help of Neural Networks. There exist a lot of different possible speech recognition algorithms applicable in this invention. The trained networks could be extended with additional training sets used in tactical operations. After the speech to text translation, the text will be analysed for used keywords important for the tactical operations.

Exemplary Embodiment

The task of the preferred embodiment is to provide weapon systems and exercise participants with an intelligent weapon simulator. This intelligent weapon simulator shall provide the following capabilities to better evaluate the correct behaviour of exercise participants:

- Seamless indoor/outdoor location of the weapon and participants in real time.
- Real-time recording and transmission of the participants' actions and evaluation of this data with artificial intelligence.
- Recording of the handling of the weapon and the target directions/distances and analysis of this data with artificial intelligence.
- Recording of the targets to be attacked and evaluation of their behaviour with artificial intelligence.
- Recording of the behaviour and reaction of the exercise participant in the event of enemy attack.
- Recording of the hit accuracy on the target and evaluation of this data with artificial intelligence.
- Identification of the targets to be engaged and evaluation of this data with artificial intelligence.
- Recording of the stress level of the participants.
- Recording and evaluation of the participants' radio messages and mission commands with artificial intelligence.

As shown in FIG. 1, the system is divided into a Sensor Unit Arrangement 9, an AI Unit 6 and a Command & Control Unit (C2 unit) 8. The AI Unit 6 is connected to the Sensor Unit Arrangement 9 or arranged in a housing together with the Sensor Unit Arrangement 9. The AI Unit 6 (also called evaluation unit or computing unit) comprises an AI portion proper, takes the input signals of the sensors of the system, and derives therefrom the data allowing assessing the performance of a participant in a simulation.

The AI Unit 6 and C2 Unit 8 communicate with each other via a radio link 51. Accordingly, the AI Unit 6 and the C2 Unit 8 each have an antenna 53. The AI Unit 6 and the Sensor Unit Arrangement 9 are centrally supplied with power by a power supply 7, e.g. a modular battery pack. The Sensor Unit Arrangement 9 controls the various sensors, including the distance sensor 1, camera 2, camera-based position sensor 3, and the shot trigger unit 5 via a Sensor Control subunit 4. All sensor information is collected by the Sensor Control 4 and then forwarded to the AI Unit 6 for further processing. The AI Unit 6 calculates the various results using Artificial Intelligence. The AI Unit 6 is arranged to send the resulting data to the C2 Unit 8 for real-time display and central history recording. Therefore, all data is sent to the C2 unit 8 in real time. The AI Unit 6 provides to the Unit C2 8, among other things, the 3D position of the Sensor Unit Arrangement 9, the Human Recognition Information, the Pose Recognition Information, the Shot Trigger Information, the Identified Objects Information, the Attack Threat Detection Information, the Distance to the Targeted Objects, and the Geo-Reference Information.

Figure 2:
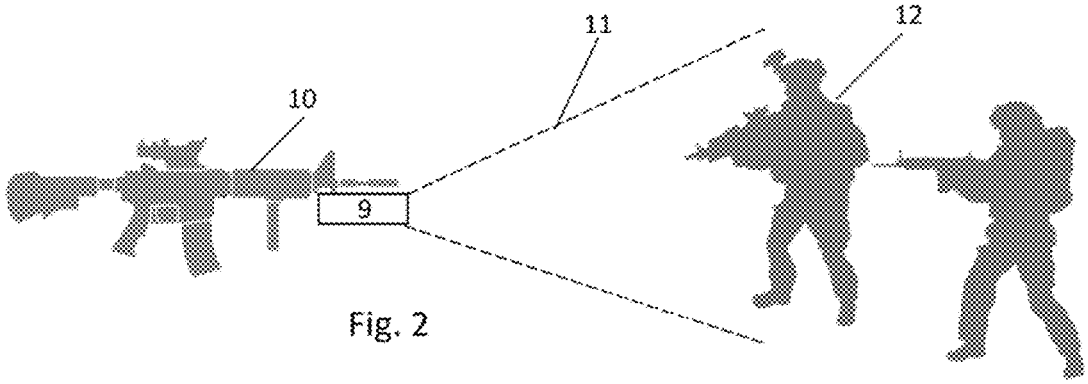
FIG. 2 shows the use of the invention in an example mounted on a weapon.

FIG. 2 shows a possible attachment of the Sensor Unit Arrangement 9 to a weapon 10. The video camera 2 of the Sensor Unit Arrangement 9 captures the environment 11 and identifies possible targets 12 or training opponents. The distance of the weapon 10 to the possible targets 12 is determined via the distance sensor 1, e.g. by LIDAR. The absolute position in space is determined by the Visual Positioning Unit 3 and the AI Unit 6. As soon as the firing trigger 5 detects a triggering of the weapon 10 of the participant 47, the determined information is processed in the AI Unit 6 and communicated to the C2 Unit 8. Local processing and subsequent storage of the data for later display is possible.

A gyroscope unit may be present in order to determine angular movement, angular speed and orientation in space.

It is not required that the personalized combat simulation equipment described in its entirety is attached to a weapon system. Merely, "attached to a weapon system" includes the situation, where parts of the equipment required for observing the use of the weapon system (e.g. camera, stereo-camera, LIDAR, gyro) are actually attached to the weapon, and the remaining parts are worn by the participant, f. i. integrated in a harness or as a belt accessory, or are remotely positioned. Thereby, the handling properties (weight, dimensions) of the weapon system are less influenced. Any intermediate distribution of the parts of the personalized combat simulation equipment between actually attached to the weapon system and a component of the section worn by the participant himself, is conceivable.

As the training system is informed of the position of the participants 12, 47, it is able to derive from the position of the targeting participant 47, the virtual trajectory of the shot and the position of the possibly targeted other persons and objects 12 if a participant in simulation or an object has been hit. Face recognition may support distinguishing between persons 47 the positions of which are too close to each other to determine which one has been virtually hit.

According to a specific, preferred aspect, the position of a weapon, or more exactly the location of the round before firing, and its target vector (corresponding to the simulated trajectory of the fired round) are published to the targets 12. Their equipment determines on the basis of these data and its own position if the person is hit. In the affirmative, the respective information (who hast been hit, where has the hit occurred) is published to the other devices and in particular to the C2 unit 8.

Figure 3:
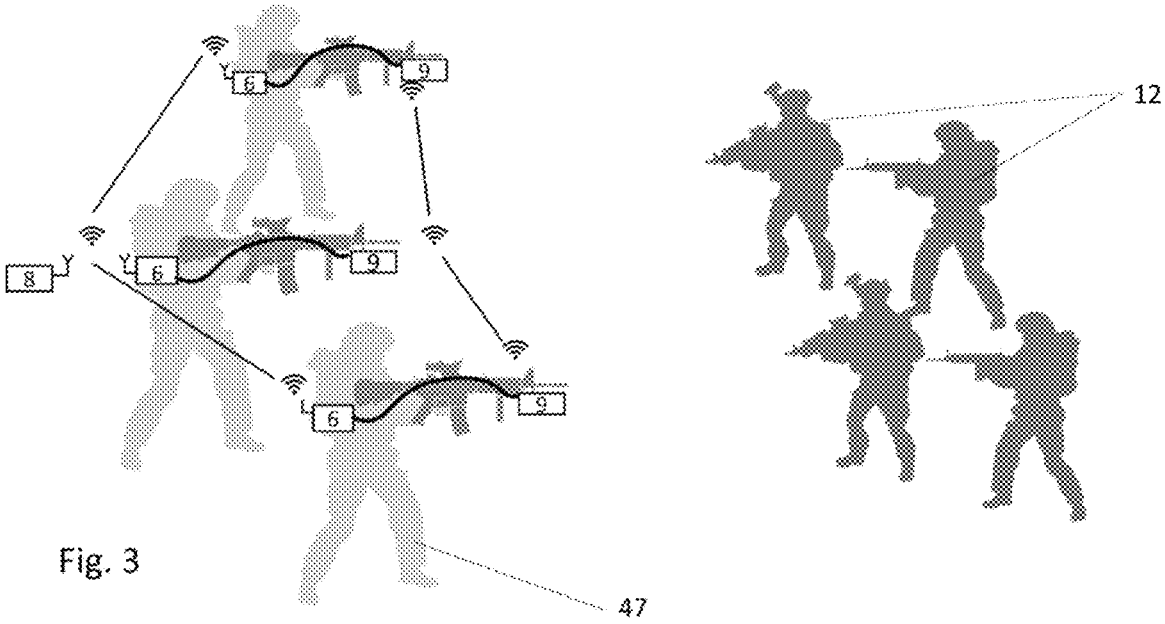
FIG. 3 shows the use of the system on the soldier.

FIG. 3 shows an arrangement of the invention. The AI Unit 6 is worn by the participant 47, for example, with the appropriate power supply. It is connected to the Sensor Unit Arrangement 9 mounted on weapon 10 via a data/power cable or wirelessly. In the wireless variant, the Sensor Unit Arrangement 9 will have its own power supply. The AI Unit 6 sends its pre-processed data over a radio network 51 to the Command & Control Unit C2 8 for further recording and analysis. In another embodiment, the Sensor Unit Arrangement 9 and the AI Unit 6 are combined into one device.

Figure 4:
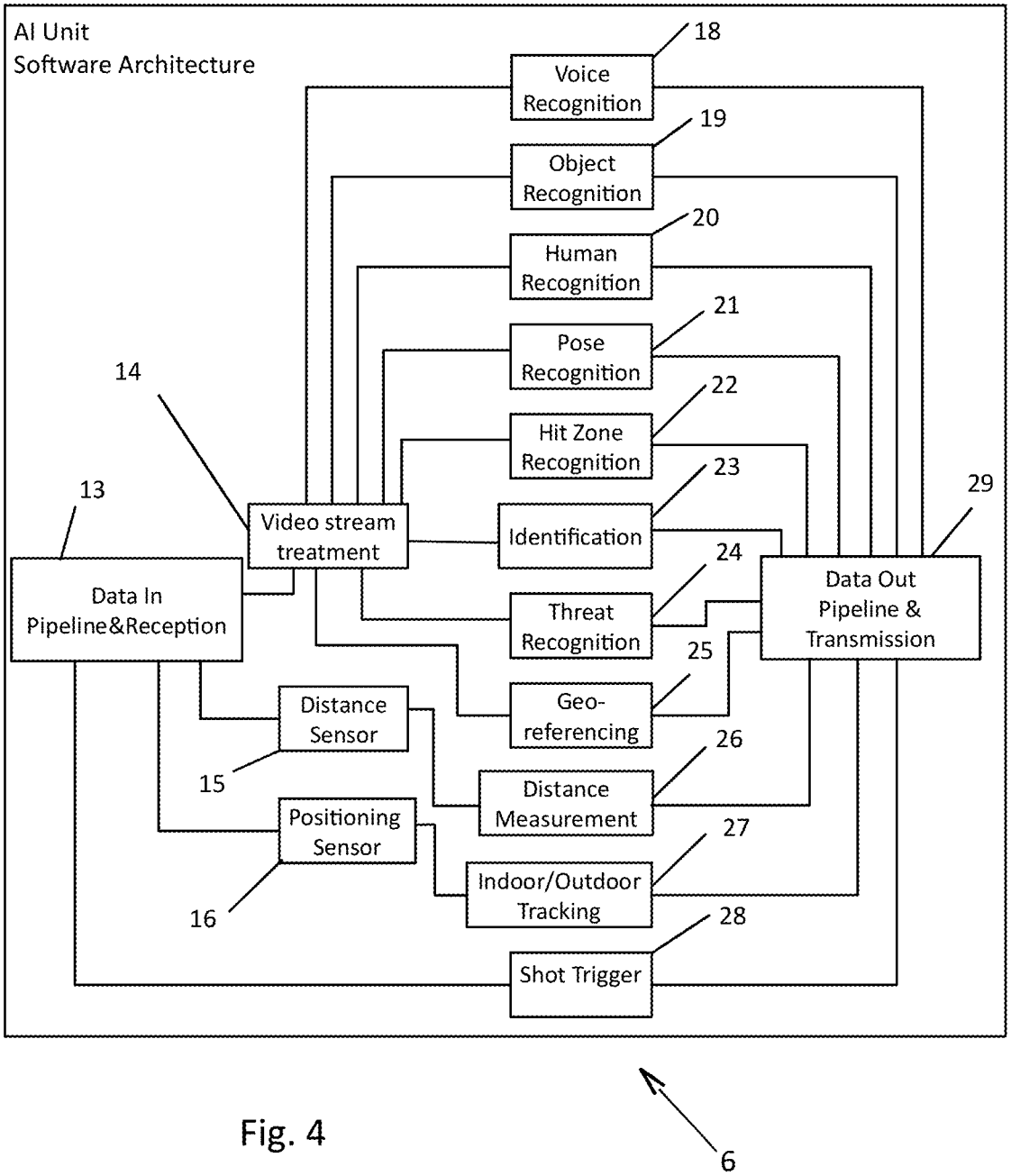
FIG. 4 shows the basic structure of the software architecture of the AI Unit

FIG. 4 shows a possible embodiment of the functions and software components of the AI Unit 6. The AI Unit 6 receives the data from the Sensor Unit Arrangement 9 via the function Data in Pipeline & Reception 13 and distributes this data to the different subunits Video Stream Treatment 14, Distance Sensor 15, Positioning Sensor 16 and Audio Stream Treatment 17. These subunits distribute the data to the various subunits pos. 18-pos. 28. The different terms of the algorithms are explained in the Definition of Terms chapter. The Video Stream Treatment unit 14 provides the corresponding Video Data Stream to the artificial intelligence units Object Recognition 19, Human Recognition 20, Pose Recognition 21, Hit Zone Recognition 22, Identification 23, Threat Recognition 24 and Georeferencing 25.

The Human Recognition unit 20 recognizes people on the Video Data Stream and tracks them in real time. The AI unit 6 thus distinguishes humans from all other objects in the video stream. The Pose Recognition unit 21 detects the limbs and joints of the detected humans in the video stream. This detection is used for the Threat Recognition unit 24 to detect and process threatening and attacking people in the video stream. The Hit Zone Recognition unit 22 compares the aimed and targeted areas on the recognized human body and forwards the results (head, neck, upper arms, lower arms, various torso areas, as well as upper and lower legs (femoral/shank)). The Identification Unit 23 is arranged to recognize people by means of facial recognition or tag recognition. Recognition via the position of the target is also possible. Thus, the AI Unit 6 is capable of assigning hits on targets to the corresponding recognized individuals. The Object Recognition function 19 is capable of recognizing, evaluating, and to pass on further object information within the video stream. The Georeferencing function 25 is used for geolocation in 3D space. By detecting a previously georeferenced marker, the Sensor Unit Arrangement 9 and, therefore, the weapon 10 is georeferenced as well. The Distance Measurement function 26 measures the distance to the respective targets in real time by means of the Distance Measurement unit 15. Thus, in addition to the distance and tracking unit (26 & 27), the respective target line and orientation of the weapon is determined. The Positioning Sensor unit 16, together with the Indoor/Outdoor Tracking unit 27, enables absolute positioning in space in real time using a SLAM (Simultaneous Localization and Mapping) software. This absolute positioning method is called an infrastructureless localisation, i.e. a localisation without relying on data furnished by the infrastructure of a known simulation environment thoroughly equipped with sensors, cameras and the like.

The Shot Trigger unit 28 detects fired shots of the weapon (e.g. by detecting a typical vibration and/or flash of the weapon) or is arranged to be triggered manually by the user via a manual Shot Trigger Button 5. All these data are collected by the Data Out Pipeline & Transmission unit 29 and transmitted as a data stream via a radio network 51 to the C2 unit 8 for display and recording for further processing. At the AI unit 6, a connected audio source (e.g. headset splitter) 55 is used to evaluate the radio transmissions during the mission. This is treated over the Audio Stream Treatment 17 and forwarded to the Speech Recognition 18. The Speech Recognition 18 analyses the radio transmission and detects mission commands using predefined keywords.

The main function of the C2 unit 8 is the management of the different sensor units and the AI unit 6 as well as their data processing and recording of the actions with the simulator. The Weapon Communication Management takes care of the management and communication with the different Sensor Unit Arrangements 9 and AI units 6 in the network. Thus, the system is arranged to track multiple participants 47, 12 and to record, manage and store their actions simultaneously. The 2D/3D mapping and georeferencing unit georeferences the weapon 10 in the 3D system of the C2 unit 8 as soon as a tag (e.g. an APRIL tag) is detected by the corresponding Sensor Unit Arrangement 9. The georeferencing is done automatically. The direction of the weapon, as well as its orientation in 3D space, is detected by the Weapon Tracking System and displayed in the MMI (Display). Selecting the Live View Control (sub-display) in the MMI, the system is arranged to show the live video image of the individual Sensor Unit Arrangements 9.

The Shot Action View unit displays and stores the current live image of the corresponding unit with all associated information (position, hit information or hit zone, stress level based on attached vitality sensors, direction of the weapon, distance, threat detection and identification of the target). Vitality sensors retrieve values of physiological parameters like speed of movement, electrical resistance of skin, temperature of skin, temperature of blood, pulse etc.

The Pose Recognition Unit 21 together with the Threat Recognition Unit 24 recognizes the detected poses and their threat potential in the live image of the corresponding Sensor Unit Arrangements 9. This information is displayed in the MMI. The Object Recognition unit 19 allows recognition of further important objects which have been previously defined. This information is displayed only via the MMI or logged. Via the Identification unit 23 the hit target is identified and thus assigned. The corresponding hit information is processed by the Impact Transmission unit and displayed in the MMI. By means of the Shot Performance History Recording all these actions of the different simulators are recorded for the After-Action Review with the actual hit image. The system is arranged that the paths of the respective exercise participants 47 are traced on a map and all Sensor Unit Arrangements 9 are tracked and recorded (stored/saved). By means of the unit After Action Review History the whole history (tracking and action history) is stored in order to be evaluated and displayed on the MMI on a 3D view map. Via the Speech Recognition Module 18, recognized keywords (pre-defined) are logged during the operation and then evaluated for the correct or incorrect commands given during the corresponding firing actions.

The Shot Performance is derived from the direction of the aiming of the weapon 10 in space, the distance of the target aimed at supplied by the distance sensor 15, and the geolocation of the weapon 10 equivalent of that of the participant 47 which altogether allow to determine a vector or trajectory in space of a simulated shot. Thereby, it is as a minimal requirement feasible to determine if a shot has hit a target and which target. According to a preferred aspect, in view of an enhanced shot performance determination, it is additionally determined where the shot has hit, i.e. the hit accuracy. Other aspects of the shot performance which may be determined by the equipment are the correct handling and bearing of the weapon. As well, the correct reaction and time involved for reacting to a threat (e.g. detected by face or pose recognition) may be determined and used for shot performance. The location of a hit (e.g. head, left/right shoulder, torso, left/right leg) may be displayed on the MMI. The location of a hit is determined by Hit Zone Recognition 22.

By means of the deployed solution, the performance during a mission as well as during an exercise can be ascertained, recorded and analysed. The AI Unit 6 described in this patent is arranged to efficiently monitor, record, and evaluate the performance of armed forces by means of artificial intelligence and additional sensor technology and is thus apt to increase the quality of training, to check the participants' correctness, and to improve the quality of the training. Furthermore, it reduces the amount of instrumentation of participants, weapons and infrastructure required for training to a minimum.

Thereby, it is feasible to determine the activity, or the performance, of a participant in a training unit exclusively on the basis of predetermined data, like a map of the training environment, positions of passive markers like, e.g. APRIL tags, and data furnished by the personalized combat simulation equipment worn by the participant herself and optionally other participants, in particular participants acting as opponents. As a consequence, it is not required to prepare a training environment by installing sensors, cameras and other means for determining the activity of the participants.

The one skilled in the art is able to conceive various modifications and variants on the basis of the preceding description without leaving the scope of protection of the invention which is defined by the appended claims. Conceivable is, f. i.:

Alternatively or additionally to SLAM, a map may be stored in advance in the system. More precisely, the map is a map of the training environment, so that the personalized combat simulation equipment is capable to perform a georeferencing of the map it generates on the basis of the camera input.

The part of the personalized combat simulation equipment attached to the weapon is designed to be attached to a vehicle or a tank or another weapon to be used or operated by persons locally present, i.e. in the simulated combat environment. In particular weapon systems are included the use of which included direct confrontation with other training participants or representations of persons simulating opponents.

In case the person bearing the personalized combat simulation equipment is permanently, or at least during the periods in time of interest, in a vehicle or other military device, parts of the equipment (up to all) not attached to the weapon are arranged in the vehicle or device, except those parts necessarily in touch with the person, like e.g. a microphone for capturing speech or sensors for measuring physiological parameters.

Face recognition is used to determine if a person constitutes a danger or risk, e.g. a hostage-taker. Additionally to other aspects like pose as set forth above, a nearby parameter of threat determination is if the person is bearing a weapon. Subsequently, it may be evaluated if the participant has properly reacted, e.g. has attacked such a person.

Face recognition is used to determine of a dangerous object is present. Like capturing the reaction to a threat by a person, the reaction to a dangerous object may be determined.

The georeferencing of the map of the environment is done only once when a fiducial marker (e.g. an APRIL tag) is detected.

A map created in using SLAM by a personalized combat simulation training equipment may be copied to other such equipments. These other equipments georeference their own position within the map in searching for the reference points (e.g. a fiducial marker) present in the received copy of the map.

Glossary

AI Artificial intelligence, cf. p. 2.

April Tag A system of fiduciary markers resembling QR codes, yet designed for precise localization by optical means like a camera.

C2 unit Command & Control Unit 8

HOG Histogram of Oriented Gradients, cf. U.S. Pat. No. 4,567,610

LIDAR Acronym for a method for determining ranges by targeting an object with a laser. LIDAR is derived from "light detection and ranging" or "laser imaging, detection, and ranging". Sometimes, it is also called 3D laser scanning. Cf. Wikipedia.org under catchword "lidar".

MMI Man-Machine-Interface: For example a screen or a display, often in connection with control organs like one or more of a button, a touch-sensitive surface ("touch-screen"), a scroll-wheel, a toggle-switch, a jog-wheel and the like.

SLAM Simultaneous Localization and Mapping, cf. p. 4.

The invention claimed is:

1. A personalized combat simulation equipment comprising sensors which is attached to a weapon system and which includes an evaluation unit, the evaluation unit being in operable connection with the sensors and capable to evaluate at least video, distance measurement, and stereo camera data for localising the weapon system and for measuring training and mission performance in order to obtain position and performance data autonomously and without being dependent on a simulation infrastructure of a training environment, wherein the evaluation unit is arranged to record and evaluate the handling and aiming of the weapon wherein the sensors include a first sensor that is configured to detect a triggering of a shot, a second sensor that is configured to detect the aiming and direction of the weapon, a third sensor that is configured to detect the distance to the target, and a fourth sensor that is configured to detect whether the weapon is loaded, whether the weapon is cocked, or whether the weapon's safety is engaged, and wherein the evaluation unit evaluates the handling and the aiming of the weapon based on the sensor data from at least the first sensor, the second sensor, the third sensor, and the fourth sensor.

2. The personalized combat simulation equipment according to claim 1, wherein the evaluation unit comprises an artificial intelligence portion.

3. The personalized combat simulation equipment according to claim 1, wherein it is provided with optical detector means, and is arranged to perform the identification of objects and people based on the signals furnished by the optical detector means.

4. The personalized combat simulation equipment according to claim 1, wherein it is arranged to perform at least one of detecting dangerous and important objects, detecting danger from attacking individuals or groups, assessing the behavior of attacking individuals or groups, and the recording and evaluation thereof, and/or wherein the personalized combat simulation equipment is arranged for recording and evaluating of detailed hit information.

5. The personalized combat simulation equipment according to claim 1, wherein it is provided with at least one sensor for retrieving one or more physiological parameters of a participant bearing the weapon and arranged for recording and evaluating the participant's stress level during the mission or exercise, and/or wherein the personalized combat simulation equipment is provided with localization means, the localization means being capable to determine the position in real time.

6. The personalized combat simulation equipment according to claim 5, wherein it is arranged to recognize a marker and to optically capture position related information visible on the marker to georeference the map.

7. The personalized combat simulation equipment according to claim 1, wherein it is operably connected to radio receiving means and arranged to evaluate radio messages of a participant bearing the personalized combat simulation equipment.

8. The personalized combat simulation equipment according to claim 1, wherein the evaluation unit is arranged to detect a target the weapon system is aimed to, to determine that the target has a human face, and to retrieve data identifying the face.

9. Use of the personalized combat simulation equipment according to claim 1, for training and deployment in an unprepared environment.

10. Combat training method, wherein the activity of a participant in the training is ascertained in using exclusively predetermined data and data furnished by at least one personalized combat simulation equipment according to claim 1, one of the personalized combat simulation equipments being attached to a weapon system worn by the participant and zero or more personalized combat simulation equipments being attached to weapon systems worn by other participants in the training.

11. The personalized combat simulation equipment according to claim 1, wherein it is provided with a) at least one of a unit for establishing a map of the environment on the basis of video data taken and at least one storage unit containing a map, and b) a unit for tracking the position of the equipment on the map.

12. The personalized combat simulation equipment according to claim 1, wherein it is operably connected to radio receiving means and arranged to evaluate radio messages of a participant bearing the personalized combat simulation equipment by at least one of speech recognition and evaluation of keywords, in order to detect expressions related to at least one of intentions of the participant, actions of the participant, and effects on the participant.

13. The personalized combat simulation equipment according to claim 1, wherein the evaluation unit performs a face recognition, in order to ascertain if the weapon system is aimed at a person and to be capable to identify the person.

14. The personalized combat simulation equipment according to claim 1, wherein the evaluation unit performs a face recognition, in order to ascertain if the weapon system is aimed at a person and to be capable to identify that the person is one of a group of persons situated close to each other.

15. Use of the personalized combat simulation equipment according to claim 1, for training and deployment in an environment wherein at least one of detectors for watching the behavior of a participant and detectors for watching objects is absent.

16. The personalized combat simulation equipment according to claim 1, wherein it is provided with a camera, and is arranged to perform the identification of objects and people based on the signals furnished by the camera.

17. The personalized combat simulation equipment according to claim 1, wherein it is arranged to perform at least one of detecting dangerous and important objects, detecting danger from attacking individuals or groups, assessing the behavior of attacking individuals or groups, and the recording and evaluation thereof by means of camera means and evaluation means for detecting a body of an object or a person and the relative positioning and orienting of parts of the body to be able to detect danger or importance of an object or a pose of the person indicative of an intention.

18. The personalized combat simulation equipment according to claim 1, wherein it is arranged to perform at least one of detecting dangerous and important objects, detecting danger from attacking individuals or groups, assessing the behavior of attacking individuals or groups, and the recording and evaluation thereof by means of camera means and evaluation means for detecting a body of an object or a person and the relative positioning and orienting of parts of the body to be able to detect danger or importance of an object or a pose of the person indicative of an intention to attack.

19. The personalized combat simulation equipment according to claim 1, wherein it is arranged for recording and evaluating of detailed hit information, the detailed hit information including targeted and/or hit objects or persons and targeted areas, and hit accuracy on targets (people and objects) during an operation and exercise.

* * * * *